US007004220B1

(12) United States Patent
Rasmussen

(10) Patent No.: US 7,004,220 B1
(45) Date of Patent: Feb. 28, 2006

(54) TRANSFER PRINTING MACHINE

(75) Inventor: Knud Villefrance Rasmussen, Silkeborg (DK)

(73) Assignee: Dansk HK Ltd., Tsuen Wan N.T. (CN)

( * ) Notice: Subject to any disclaimer, the term of this patent is extended or adjusted under 35 U.S.C. 154(b) by 0 days.

(21) Appl. No.: 09/914,852

(22) PCT Filed: Mar. 1, 2000

(86) PCT No.: PCT/DK00/00085

§ 371 (c)(1),
(2), (4) Date: Sep. 10, 2001

(87) PCT Pub. No.: WO00/53419

PCT Pub. Date: Sep. 14, 2000

(30) Foreign Application Priority Data

Mar. 11, 1999 (DK) ..... 1999 00342

(51) Int. Cl.
*B41F 16/00* (2006.01)
*B41F 16/02* (2006.01)
*B41F 7/20* (2006.01)
*G03G 15/16* (2006.01)

(52) U.S. Cl. ..... 156/540; 156/384; 101/216; 101/217; 118/257; 399/297

(58) Field of Classification Search ..... 156/540, 156/238–240, 230, 384, 387; 101/470, 212, 101/216, 217, 219, 492; 68/8, 50; 118/257; 8/151; 399/297, 307
See application file for complete search history.

(56) References Cited

U.S. PATENT DOCUMENTS 4,057,864 A * 11/1977 Wild ..... 101/472
4,116,022 A * 9/1978 Lopata et al. ..... 101/470
4,287,017 A * 9/1981 Lopata et al. ..... 101/470
4,420,307 A * 12/1983 Gorondy ..... 8/444
4,442,560 A * 4/1984 van Wersch et al. ..... 8/151
4,455,845 A * 6/1984 Schiffer ..... 68/204
5,062,723 A * 11/1991 Takeda et al. ..... 101/407.1
5,223,071 A * 6/1993 Gersbeck ..... 156/358
5,953,573 A * 9/1999 Eum ..... 399/308

FOREIGN PATENT DOCUMENTS

DE 2514199 A * 10/1976
DE 4208981 A1 * 9/1993

* cited by examiner

*Primary Examiner*—Sue A. Purvis
(74) *Attorney, Agent, or Firm*—Oliff & Berridge, PLC

(57) ABSTRACT

Machine for transfer pattern printing of a textile web, said machine comprising a centre roller (1), at least one pressure roller (2), a tension roller (3), a reversing roller (4) and an endless belt (5) which is of a width substantially corresponding to the length of the pressure roller (2). The endless belt (5) extends about the tension roller (3) and the reversing roller (4), and a first portion (8) of the periphery of the pressure roller (2) abuts and exerts a pressure on the centre roller (1). While in continuous contact with one another, a pre-printed pattern-carrying web (6) and the textile web (7) can pass between the centre roller (1) and the pressure roller (2) and here be subjected to a local compression. The endless belt (5) is guided around a second portion (9) of the periphery of the pressure roller (2), said second portion being positioned substantially diametrically opposite the first portion (8) of said periphery of the pressure roller, whereby the pressure exerted by the pressure roller (2) on the centre roller (1) is adjustable by an adjustment of the tension in the endless belt (5) by means of the tension roller (3).

9 Claims, 1 Drawing Sheet

TRANSFER PRINTING MACHINE

TECHNICAL FIELD

The invention relates to a machine for transfer pattern printing of textile webs, said machine comprising a centre roller, at least one pressure roller, a tension roller, a reversing roller and an endless belt which is of a width substantially corresponding to the length of the pressure roller and which extends about the tension roller and the reversing roller, and where a first portion of the periphery of said pressure roller abuts and exerts a pressure on said centre roller with the result that a pre-printed pattern-carrying web and the textile web are subjected to a local compression, said preprinted pattern-carrying web and said textile web being in contact with one another and passing between said centre roller and said pressure roller.

BACKGROUND ART

Transfer pattern printing is a technique involving a continuous transfer of a pre-printed pattern from a pattern-carrying web to the textile web, where the two webs are continuously brought into contact with one another in a transfer region which is frequently in the form of one or more pairs of pressure rollers.

Transfer pattern printing is a technique which has been used for a long time and which has been commercially interesting since the 19-fifties, especially in form of sublimation transfer printing for use in connection with printing on textile webs of synthetic fibres. Compared to a direct textile printing, the latter sublimation transfer printing ensures the advantage that it is possible very quickly to adapt the production to other patterns in such a manner that it is only necessary to keep a stock of the designs presenting an actual demand. The direct textile printing necessitates, however, in practice often the production of rather large stocks of the individual designs in order to maintain the costs per printed unit of length of the textile web at a reasonable level.

Another advantage obtained by the transfer pattern printing is found in the fact that it is possible to obtain a rather sharp and finely detailed transfer of the patterns, said patterns in advance being printed by means of suitable dyes and with the required fineness and sharpness on a suitable pattern-carrying web.

As a result of the above, the transfer pattern printing has gradually become highly interesting, and various types of the technique has been described in several publications within the patent literature.

U.S. Pat. No. 4,057,864 describes a machine which according to the preamble of claim 1 is to be used for wet transfer pattern printing, and where the pattern-carrying web and the textile web held together one on top of the other are moved about the centre roller and kept in contact therewith by means of an endless belt guided around a portion of the periphery of said centre roller. Some pressure rollers along the periphery of the centre roller provide local compressions of the pattern-carrying web and the textile web.

The transfer pattern printing and other types of roller processes are encumbered with the general problem of obtaining a uniform, linear pressure in the entire length of said rollers, i.e. in the entire width of the textile web, said width often being several meters. This problem is caused by the rollers of one pair of rollers exclusively being supported at the ends. Thus both rollers curve away from one another in the middle due to the pressure, which results in a less linear pressure in the middle. In turn the latter causes a non-uniform transfer of the printed pattern from the pattern-carrying web to the textile web, said transfer often being insufficient in the middle. This problem grows along with an increase of the length of the rollers used and along with an increase of the linear pressure required.

DK-PS No. 169,135 discloses a process for transfer pattern printing of a textile web between pairs of rollers under such a high pressure that the transfer of the pattern from the pattern-carrying web to the textile web can be carried out without the use of heat. The above problem of obtaining a uniform linear pressure applies in particular to this process because a linear pressure of up to 50 kg/cm is used by this process.

Previously, attempts have been made at solving this problem by means of particular pressure rollers where the interior of said roller is subjected to a radially outward pressure by means of a hydraulic fluid in such a manner that the surface of said roller is sufficiently deformed so as to ensure a uniform linear pressure in the entire length of said roller. A system using such rollers is, however, encumbered with the drawback that it is very expensive to produce because it requires a complete hydraulic system with pumps, reservoirs, hydraulic pipes and complicated gaskets between the mutually movable parts.

BRIEF DESCRIPTION OF THE INVENTION

The object of the invention is to provide a machine for transfer pattern printing, where it is possible even in connection with very high linear pressures to obtain a uniform linear pressure in the entire width of the textile web.

The machine for transfer pattern printing is according to the invention characterised in that the endless belt is guided around a second portion of the periphery of the pressure roller, said second portion being positioned substantially diametrically opposite the first portion of said periphery of the pressure roller, whereby the pressure exerted by the pressure roller on the centre roller is adjustable by an adjustment of the tension in the endless belt by means of the tension roller. The resulting linear pressure exerted by the pressure roller on the centre roller is uniform in the entire length of said pressure roller because said pressure roller is subjected in its entire length to a uniform linear force by the endless belt.

According to a preferred embodiment, the endless belt is guided around a substantial portion of the periphery of the centre roller and through the nip between the pressure roller and the centre roller. As a result a reliable guidance of the pattern-carrying web and the textile web between the endless belt and the centre roller is obtained, and in addition to the local compression in the nip between the pressure roller and the centre roller a further comparatively weaker compression is obtained of the two webs across an increased portion. The latter can be advantageous in connection with the transfer of the pattern from the pattern-carrying web to the textile web.

The endless belt is preferably made of a waterproof, essentially non-stretchable material, whereby it is ensured that the pressure roller can subject the centre roller to a sufficiently high linear pressure, and that fluid and dye are not sucked out of the textile web.

The endless belt is preferably made of an aramide-fibre reinforced (Kevlar®) rubber blanket presenting a high ultimate stress, a high elastic modulus, dimensional stability and an outstanding resistance to moisture.

The machine may according to a preferred embodiment comprise two pressure rollers, which turned out to increase the transferring effect.

One or more of the rollers, preferably the reversing roller, may present a convex (bombé) cylindrical surface. As a result an increased tensioning of the endless belt is obtained in the middle, whereby said belt does not move towards the ends of the rollers during operation. In addition, this tensioning assists in ensuring that the linear pressure is equally high at the middle of the pressure roller as well as at the ends of said pressure roller.

According to a preferred embodiment, the reversing roller is the driving roller which in connection with the rotation drives the remaining rollers and the endless belt.

BRIEF DESCRIPTION OF THE DRAWINGS

The invention is described in greater detail below with reference to the accompanying drawing, in which.

BEST MODE FOR CARRYING OUT THE INVENTION

Figure 1:
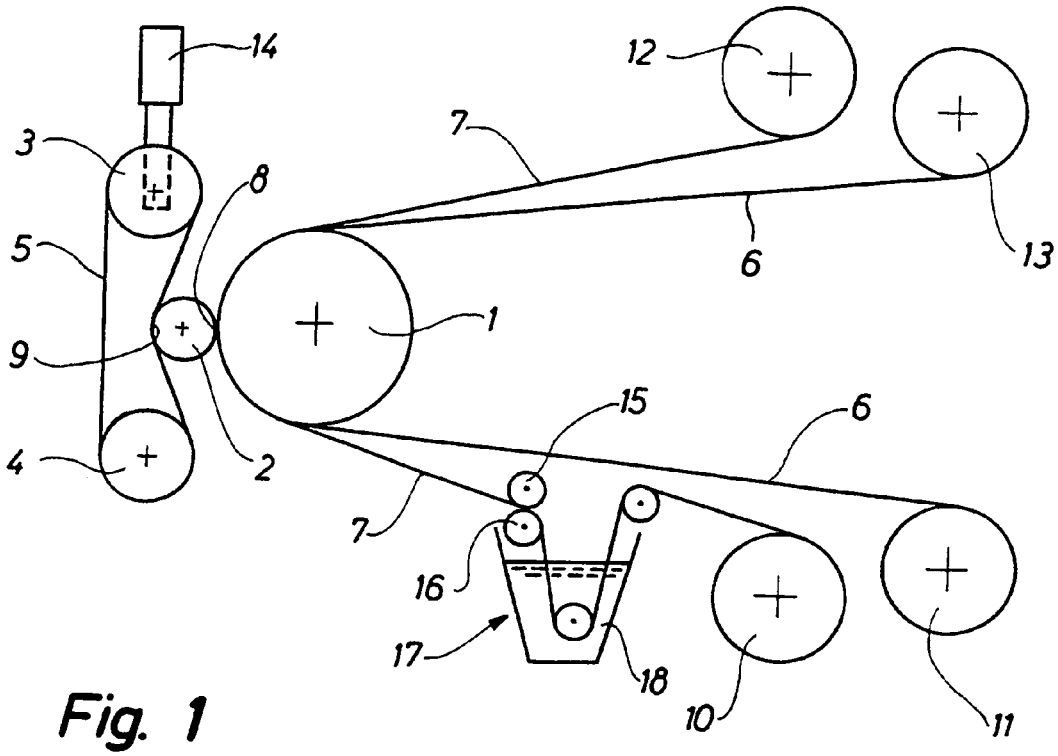
FIG. 1 is a diagrammatic view of a machine according to the invention.

The machine shown in FIG. 1 for transfer pattern printing of a textile web comprises a centre roller 1, a pressure roller 2, a tension roller 3, a reversing roller 4 and an endless belt 5. A textile web 7 to be printed is wound off an unwind roll 10 and brought into contact with a pattern-carrying web 6. The pattern-carrying web is wound off an unwind roll 11 and guided into the transfer region between the pressure roller 2 and the centre roller 1. While passing from the roll 10 to the centre roller 1, the textile web 7 is carried through an impregnating unit 17 in which said web 7 is immersed in a fluid bath 18 and subsequently carried through a pair of rollers 15, 16 pressing as much fluid out of said textile web as possible whereby the resulting web contains an exactly defined residual moisture. The textile web 7 and the pattern-carrying web 6 are joined at a speed of up to 50 m/minute, preferably 10 to 20 m/minute, and carried between the centre roller 1 and the pressure roller 2 exerting a linear pressure of up to 50 kg/cm. As a result, a predetermined quantity of moisture is pressed out of the textile web 7 with the effect that said textile web 7 soaks the pattern-carrying web and consequently the carrier for the dye. In this manner the carrier is activated, viz. swells, whereby the dye is pressed very quickly—i.e. in a split second—into or penetrates far into the textile web 7. This effect is intensified by the moist textile web 7 initially being compressed and subsequently after leaving the pair of rollers by said web absorbing the dye and the carrier. Then the textile web 7 and the pattern-carrying web 6 leave the centre roller 1 and are wound on the rolling-up rolls 12 and 13. In a first portion indicated by the reference numeral 8, the pressure roller 2 is in contact with the centre roller 1, and in a second portion 9 positioned diametrically opposite said first portion said pressure roller 2 is in contact with the endless belt 5. The endless belt 5 is guided around the reversing roller 4 and the tension roller 3. The tension roller 3 can be vertically moved by means of a pneumatic cylinder 14 in a direction away from said reversing roller 4 so as to tighten the endless belt 5. A tightening of the endless belt 5 increases the pressure on the pressure roller 2 and consequently the pressure of said pressure roller on the centre roller 1. The endless belt 5 is of a width corresponding to the length of the pressure roller 2, and accordingly said belt subjects said pressure roller 2 to a uniform linear pressure in the entire length of said pressure roller which in turn exerts a uniform linear pressure on the centre roller 1. In order to provide a linear pressure of up to 50 kg/cm, the endless belt 5 is made of an aramide-fibre reinforced (Kevlar®) rubber blanket. At the ends the pressure roller 2 is mounted in guides (not shown) whereby said pressure roller can be moved towards and away from the centre of the centre roller 1.

Figure 2:
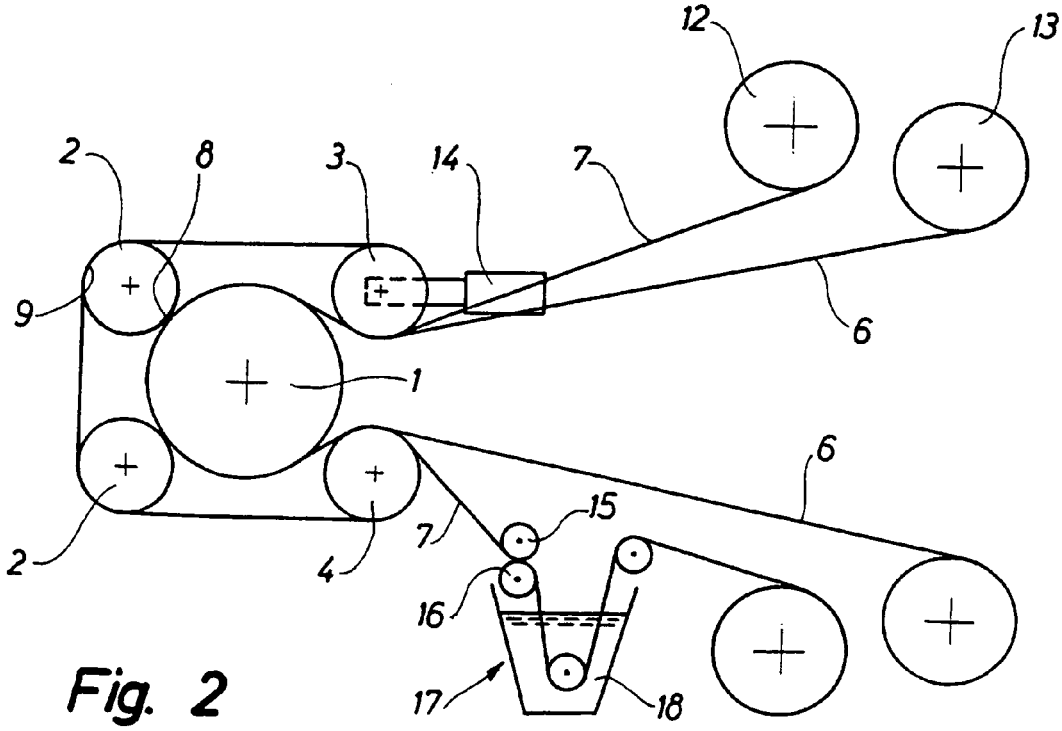
FIG. 2 is a diagrammatic view of a preferred embodiment of a machine according to the invention.

FIG. 2 shows a preferred embodiment of a machine for transfer pattern printing according to the invention. The machine of FIG. 2 differs from the machine of FIG. 1 by comprising two pressure rollers 2 and by the endless belt 5 extending around a substantial portion of the periphery of the centre roller 1 and through the nip between said pressure rollers 2 and said centre roller 1. As a result the textile web 7 and the pattern-carrying web 6 are compressed along the entire portion of the periphery of the centre roller 1 which is surrounded by the endless belt 5. In addition, the webs are compressed locally between he pressure rollers 2 and the centre roller 1. This structure turned out to be particularly advantageous because the textile web and the pattern-carrying web are smoothed out between the endless belt 5 and the centre roller 1 before they reach the first pressure roller 2. When the textile web and the pattern-carrying web leave the first pressure roller 2, said webs are reliably fixed relative to one another between the endless belt 5 and the surface of the centre roller 1 until they reach the second pressure roller 2 where they are again subjected to a high linear pressure with the result that the transferring effect is intensified.

The invention is not restricted to the above embodiments. Three or more pressure rollers can for instance be arranged along the periphery of the centre roller.

The invention claimed is:

1. A machine for transfer pattern printing of a textile web, said machine comprising a center roller, at least one pressure roller, a reversing roller, a tension roller that can move towards and away from the reversing roller and an endless belt, which is of a width substantially corresponding to a length of the pressure roller and which extends about the tension roller and the reversing roller, and where a first portion of a periphery of said pressure roller abuts and exerts a pressure on said center roller with a result that a pre-printed pattern-carrying web and the textile web are subjected to a local compression because said pre-printed pattern-carrying web and said textile web are in contact with one another and pass between said center roller and said pressure roller, wherein the endless belt is guided around a second portion of the periphery of the pressure roller, said second portion being positioned substantially diametrically opposite the first portion of said periphery of the pressure roller, whereby the pressure exerted by the pressure roller on the center roller is adjustable by an adjustment of a tension in the endless belt by moving the tension roller towards or away from the reversing roller.

2. The machine as claimed in claim 1, wherein the endless belt is guided around a substantial portion of a periphery of the center roller and through a nip between the pressure roller and said center roller.

3. The machine as claimed in claim 1, wherein the endless belt is made of a waterproof, essentially non-stretchable material.

4. The machine as claimed in claim 1, wherein the endless belt is made of an aramide-fiber reinforced rubber blanket.

5. The machine as claimed in claim 1, wherein the machine comprises two pressure rollers.

6. The machine as claimed in claim 1, wherein one or more of the rollers comprise(s) a convex surface.

7. The machine as claimed in claim 6, wherein the reversing roller comprises the convex surface.

8. The machine as claimed in claim 6, wherein a cylinder can move the tension roller towards and away from the reversing roller.

9. The machine as claimed in claim 1, wherein the reversing roller is driving.

* * * * *